US010946537B2

(12) United States Patent
Danmola

(10) Patent No.: US 10,946,537 B2
(45) Date of Patent: Mar. 16, 2021

(54) ADJUSTABLE, POSITIONABLE GUARD FOR HAIR CLIPPERS

(71) Applicant: Wasiu A. Danmola, College Park, GA (US)

(72) Inventor: Wasiu A. Danmola, College Park, GA (US)

( * ) Notice: Subject to any disclaimer, the term of this patent is extended or adjusted under 35 U.S.C. 154(b) by 0 days.

(21) Appl. No.: 16/252,654

(22) Filed: Jan. 20, 2019

(65) Prior Publication Data

US 2020/0230832 A1 Jul. 23, 2020

(51) Int. Cl.
*B26B 19/20* (2006.01)
*B26B 19/38* (2006.01)
*B26B 19/06* (2006.01)

(52) U.S. Cl.
CPC ..... *B26B 19/20* (2013.01); *B26B 19/3813* (2013.01); *B26B 19/06* (2013.01)

(58) Field of Classification Search
CPC ..... B26B 19/20; B26B 19/3813; B26B 19/06; B26B 19/3846
See application file for complete search history.

(56) References Cited

U.S. PATENT DOCUMENTS 2,481,097 A * 9/1949 Fewins ..... B26B 19/20 30/200
2,747,277 A * 5/1956 Esposito ..... B26B 19/20 30/200
2,974,412 A * 3/1961 Clark ..... B26B 19/20 30/201
3,041,726 A * 7/1962 Hitson ..... B26B 19/20 30/201
3,149,418 A * 9/1964 Milbourne ..... B26B 19/20 30/201
3,334,416 A * 8/1967 Green ..... B26B 19/20 30/200
3,648,370 A * 3/1972 Cercone ..... B26B 19/20 30/201
6,079,103 A * 6/2000 Melton ..... B26B 19/20 30/43.92
7,051,442 B2 5/2006 McCambridge et al.
8,844,142 B2 * 9/2014 Kammer ..... B26B 19/3846 30/201
10,307,920 B1 * 6/2019 Sanchez ..... B26B 19/20
(Continued)

*Primary Examiner* — Jonathan G Riley
(74) *Attorney, Agent, or Firm* — J. T. Hollin, Attorney-at-Law, P.C.

(57) ABSTRACT

The inventive concept presented is a single, adjustably positionable Clipper Guard attachment for use with clippers. The primary objective of the inventive concept is to provide barbers and hair stylists with a more convenient, better performing appliance. The single clipper guard may conveniently be adjusted and readjusted to enable the selection of different degrees of closeness of hair trimming or cutting. The Clipper Guard is comprised of two components: a Sliding Body and a Retainer. The Sliding Body accepts the outer plane of the Retainer by means of a T-shaped key and shaft on the outer plane of the Retainer, fitting internally into a slot within the Sliding Body. A mechanically-positionable pin mechanism, stored interiorly to the Retainer, is maneuvered so as to lock the two components into different functional relationships, providing differing lengths or heights to which hair or other substance may be cut or trimmed.

5 Claims, 8 Drawing Sheets

(56) References Cited

U.S. PATENT DOCUMENTS

Figure 1:
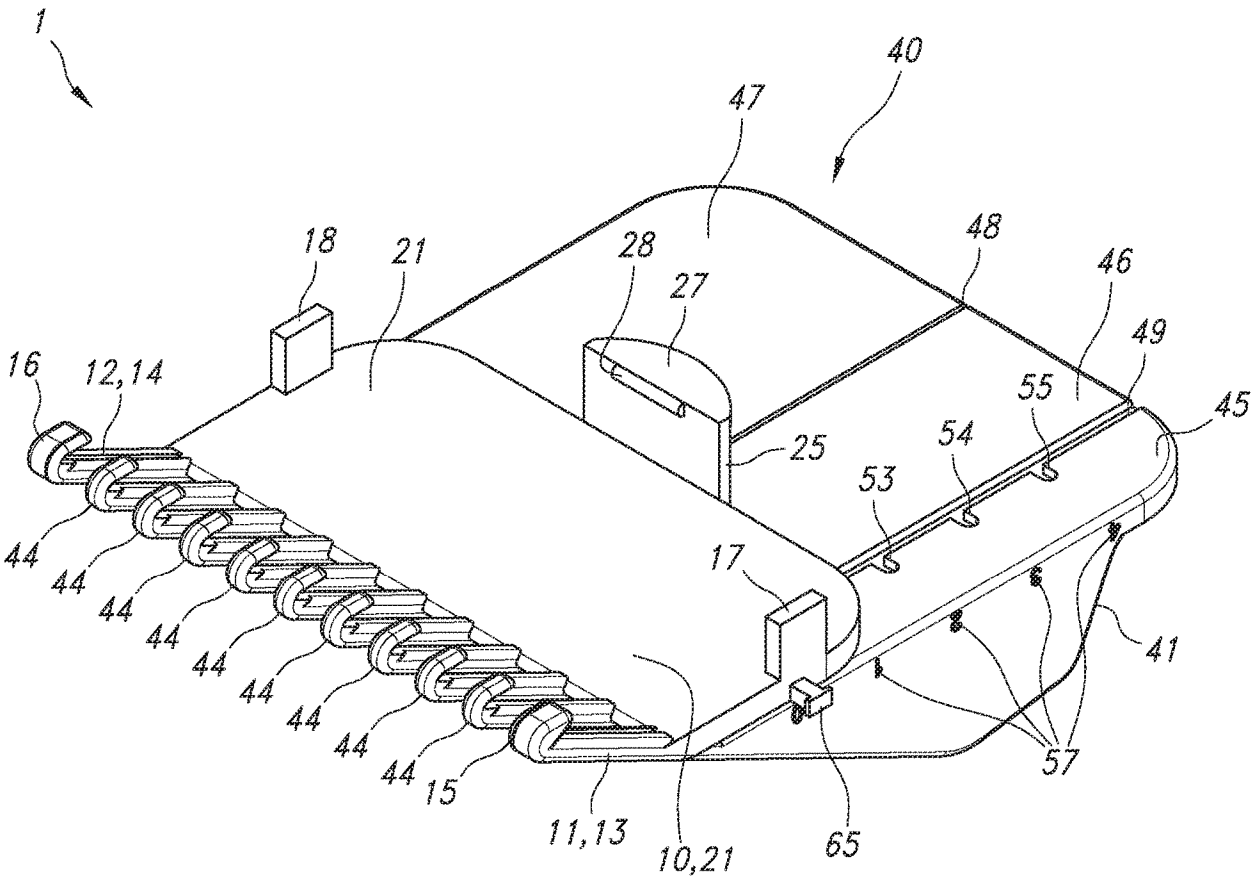

| | | | | |
|---|---|---|---|---|
| 2007/0107234 | A1* | 5/2007 | Yao | B26B 19/205 30/201 |
| 2009/0113722 | A1* | 5/2009 | Werner | B26B 19/20 30/200 |
| 2009/0188117 | A1 | 7/2009 | Putzer | |
| 2009/0218252 | A1* | 9/2009 | Michel | B26B 21/12 206/581 |
| 2011/0061243 | A1 | 3/2011 | Smit | |
| 2013/0219724 | A1* | 8/2013 | Werner | B26B 19/20 30/201 |

* cited by examiner

ADJUSTABLE, POSITIONABLE GUARD FOR HAIR CLIPPERS

CROSS-REFERENCES TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION

(1) Field of the Invention

The field of the present inventive concept relates generally to methods and equipment utilized to position, guard, and guide the cutting teeth of hair clippers, whether manually operated or electrically powered. It is common in the hair grooming industry to use a powered hair clipper for trimming a subject's hair. One aspect of hair styling is the trimming of hair which grows in the vicinity of the ears.

It is the task of both amateur and professional hair cutters and stylists, to take care so as to prevent clipping adjacent areas of the head in a way which provides an uneven appearance. Typically, the clippers must be carefully positioned to achieve hair trimming while maintaining the overall taper of the hairstyle. Further, the person performing such trimming must frequently engage in back-and-forth removal of one size or length of clipper guard and replace with a different-sized guard to make progress toward the graduated trimming of the subject's hair.

Obviously, it would be convenient and efficient to use a single clipper guard device that can itself be adjusted to provide differing heights for guidance and support of the clippers while performing the hair trimming functions. The single clipper guard would remain attached to the clippers during the entirety of the hair trimming process.

(2) Description of the Related Art, Including Information Disclosed Under 37 CFR 1.97 and 1.98

U.S. Published patent application Ser. No. 12/881,622; 14 Sep. 2010; Smit, A. A comb comprising a base configured to secure the comb to a trimming device, primary teeth configured to provide a fixed distance from a cutting edge of the trimming device, and secondary teeth configured to manipulate hair to a predetermined orientation relative to the cutting edge.

U.S. Pat. No. 7,051,442; McCambridge, et al. 30 May 2006; An ear area comb attachment for attachment to a hair clipper having a bladeset with a moving blade laterally reciprocating relative to a stationary blade includes a base configured for attachment to the clipper and a guard formation associated with the base for blocking access to a central portion of the bladeset and defining a cutting area at at least one end portion. At least one hair feed guide is associated with the base for guiding hair strands toward the cutting area.

U.S. Published Patent Application #2009/0188117 30 Jul. 2009; Putzer, A. To avoid miscuts while providing a comfortable usability a comb device (3) for a hair-cutting system (1) is proposed, the comb device (3) comprising a comb unit (4) with teeth (71) and connecting means (8) for connecting the comb device (3) to a hair-cutting apparatus (2), wherein the comb unit (4) comprises a first part (5) being in a fixed position with respect to the connecting means (8) and having teeth (71) and a second part (6) being movable with respect to the connecting means (8), as well a hair-cutting system comprising a hair-cutting apparatus and such a comb device (3) and being divided in two or more movable subparts (61, 62) that are arranged to move independently from each other.

BRIEF SUMMARY OF THE INVENTION

The inventive concept presented is an adjustable and positionable Clipper Guard 1 attachment for use with hair clippers. The primary objective of the inventive concept is to provide barbers, hair stylists, or any person who uses electric clippers, with a more convenient, better performing appliance. The device comprises a single, self-adjusting hair clipper guard which may conveniently be positioned and/or re-positioned to enable the selection of different degrees of closeness of hair trimming or cutting.

The inventive concept comprises two separate parts; a Sliding Body 40 and a Retainer 10. The Retainer 10 is constructed so as to securely grasp the smooth plane 5 of an electric hair clipper 2 by abutment to an inner plane 21 of the Retainer 10 and simultaneously, within the confines of a left post 17, a right post 18, and a semi-rigid rear bracket 25. Further, the teeth-holding structure 4 of the meshing teeth 3 of the hair clipper 2 is inserted into the Retainer 10 so as to be mounted within the left arm 11, left hook 15, left armrest 13, right arm 12, right hook 16, and right armrest 13 of the Retainer 10

The Sliding Body 40 manifests a plurality of parallel, tapered, symmetrically-spaced prongs 43 emanating from a base flange 56, each prong 43 culminating in a fixed clasp 44. Upon insertion of a set of clippers 2 into the Retainer 10, In the preferred embodiment, the Sliding Body 40 accepts a mechanical connecting of the outer plane 22 of the Retainer 10, by means of a T-shaped key 30 and shaft 32 on the outer plane of the Retainer 10, which fit internally into a corresponding T-shaped slot 48 running lengthwise of the Sliding body 40. For enhanced functionality, a mechanically positionable pin 60 and peg 63 combination on one side of the Retainer 10 are insertable into any of a series of notches 51, 52, 53, 54, 55 between a left plate 45 and a mid-plate 46 on the body of the Sliding Body 40. In this manner, the combined Retainer 10 and Sliding Body 40 adjustably control the height of the teeth 3 of the hair clipper 2 above the substance to be cut. Also, the functionality of the pin 60 placement serves to control the length of exposed edges of the teeth of a hair clipper so as to correspond to the desired length to which a subject's hair (in the preferred embodiment) may be cut or trimmed.

BRIEF DESCRIPTION OF THE VIEWS OF DRAWINGS AS EXEMPLARY EMBODIMENTS OF THE INVENTIVE CONCEPT

FIG. 1 depicts a three-dimensional top-side view of the interior structure of the Clipper Guard 1 inventive concept. This view presents the fully-operational adjoinment of the Retainer 10 and the Sliding Body 40, the two main components of the Clipper Guard 1.

Figure 2:
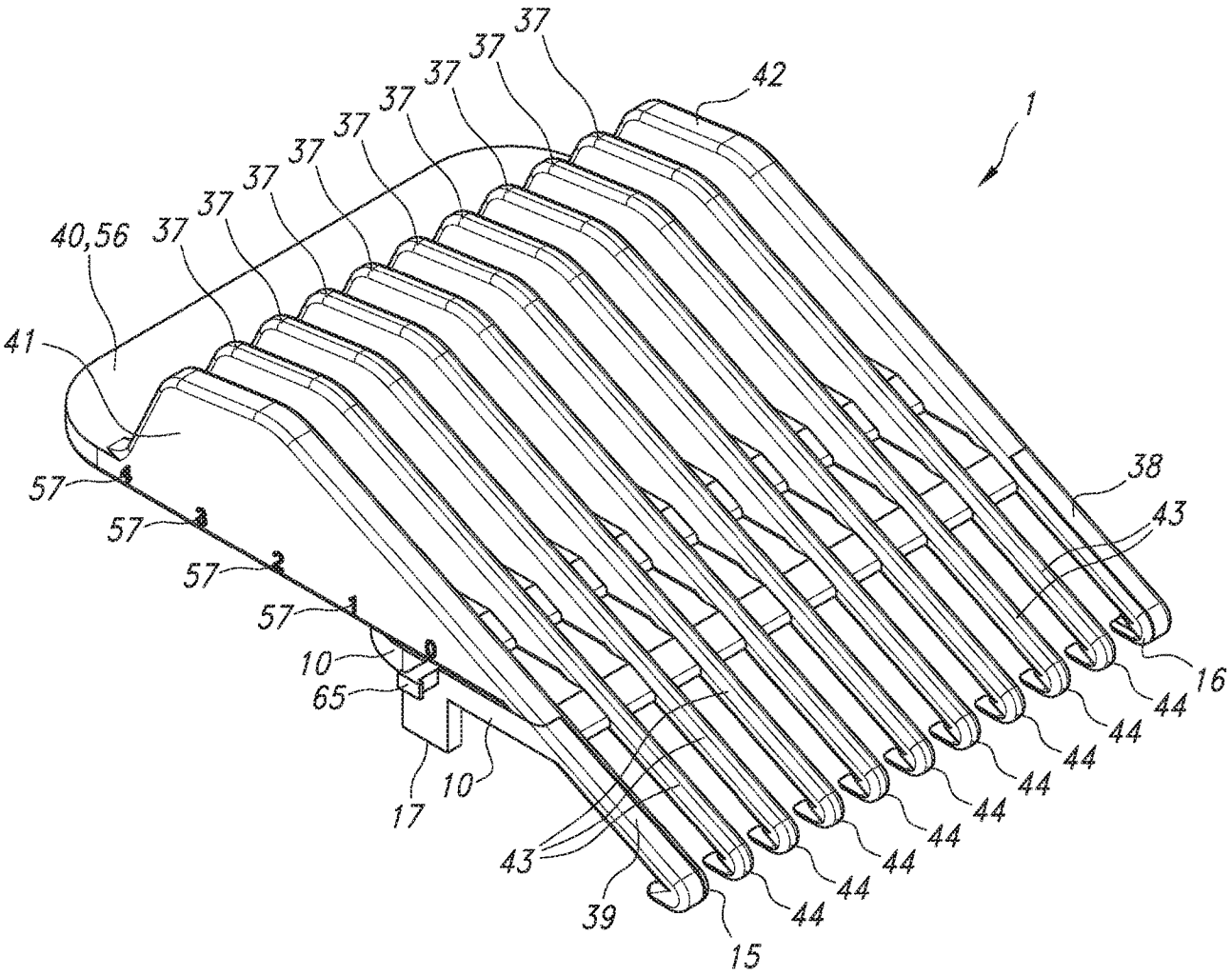

FIG. 2 illustrates a bottom-up view of the Clipper Guard 1, primarily showing, as components of the Clipper Guard 1, the understructure of the Sliding Body 40, a plurality of stators 37 of the Sliding Body 40, which stators 37 transition into lengthwise, tapered, prongs 43. Further, partially visible is a small segment of the Retainer 10 connected to the Sliding Body 40.

Figure 4:
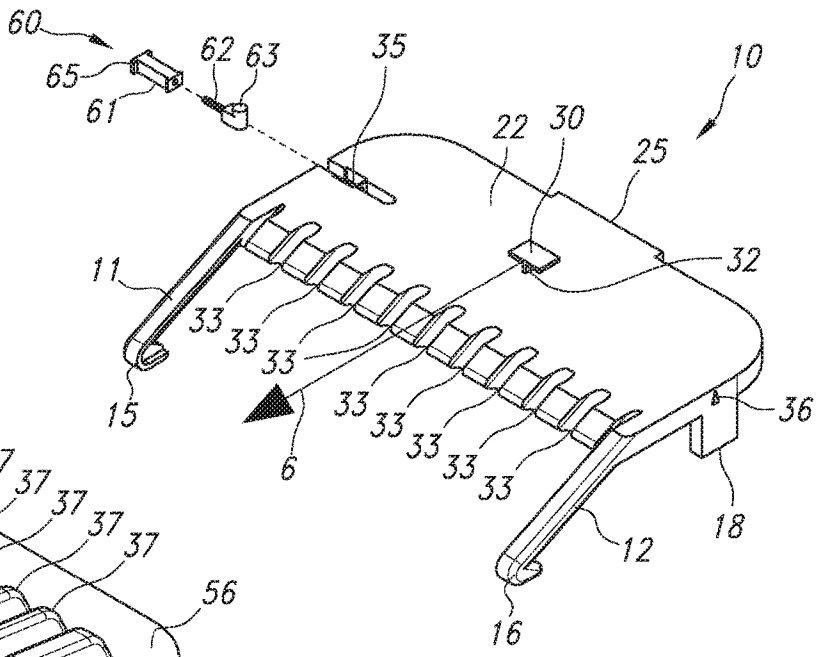
Figure 3:
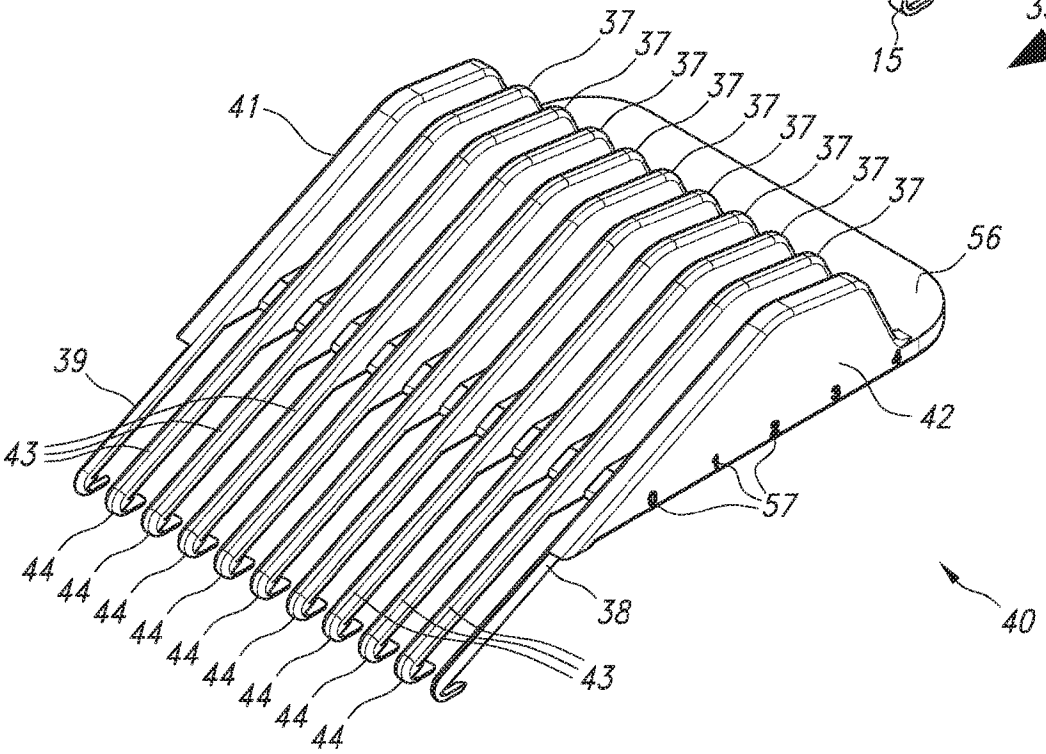

FIG. 3 and FIG. 4 show both the Sliding Body 40 and Retainer 10, respectively, as having been disconnected and separated one from the other.

Figure 5:
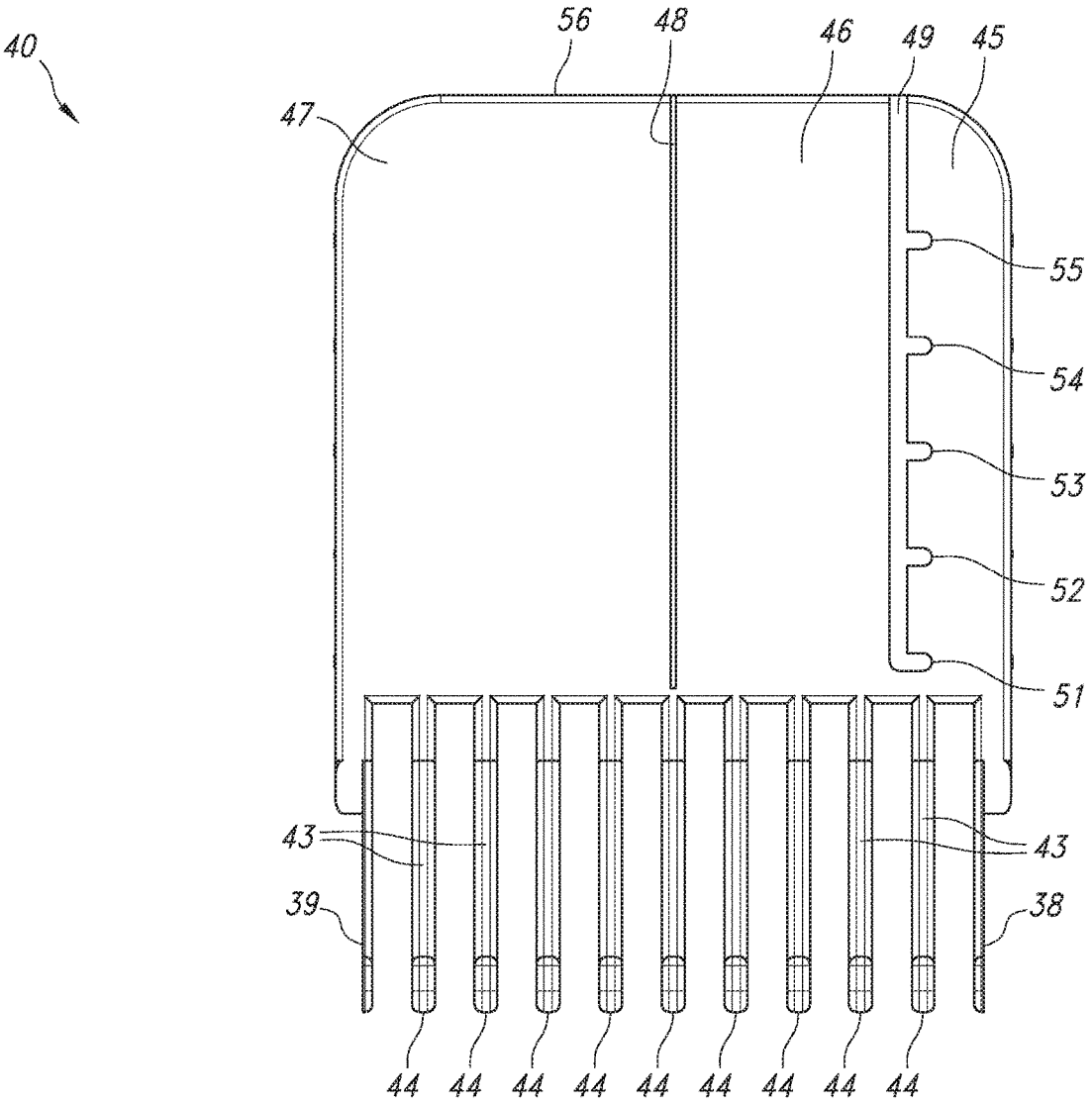

FIG. 5 presents a view of the upper structure of the Sliding Body 40, further showing a slot 48, a channel 49, a plurality of notches 51, 52, 53, 54, 55 which notches serve to retain the peg 63 of a pin 60 mechanism. Further shown are nine prongs 43 and a left and right supporter 38, 39, extending parallel and outward from the structure of the Sliding Body 40.

Figure 6:
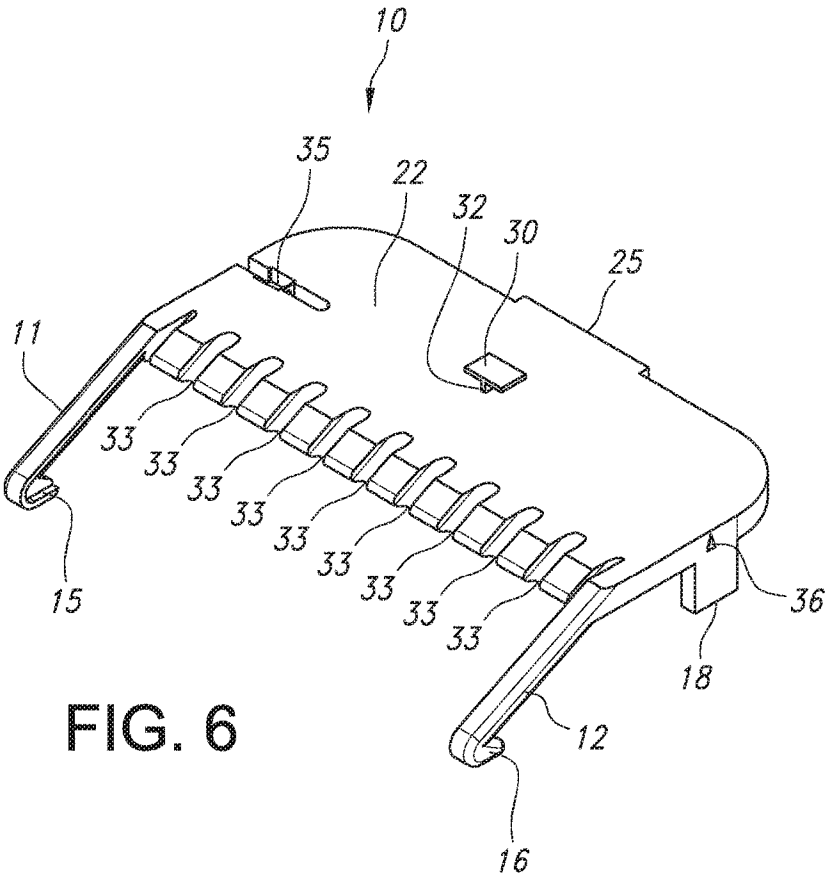

FIG. 6 is a view of the Retainer 10, further showing its outer plane 22, a right arm 12, a left arm 11, the right post 18, the bay 35 which provides stowage of the pin 60 mechanism, and nine grooves 33, which grooves 33 are symmetrically spaced to receive a small segment of each of the prongs 43 of the Sliding Body 40.

Figure 7:
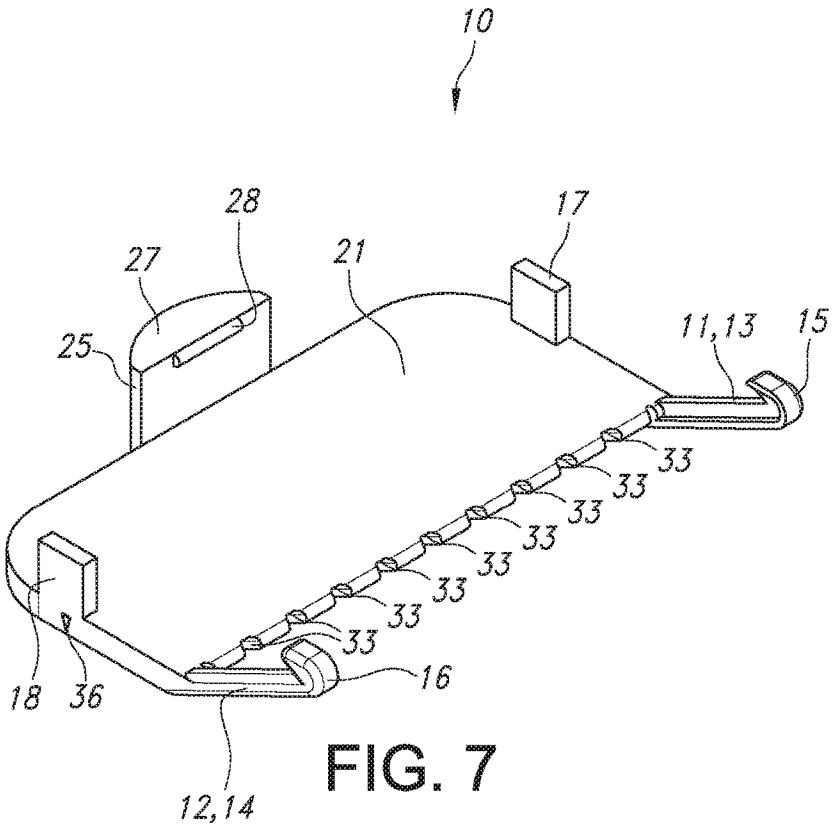

FIG. 7 displays the interior structure of the Retainer 10, showing its inner plane 21, left and right posts 17, 18, a bracket 25, a lip 28, grooves 33, the right arm 12, right armrest 14, the left arm 11, and left armrest 13.

Figure 8:
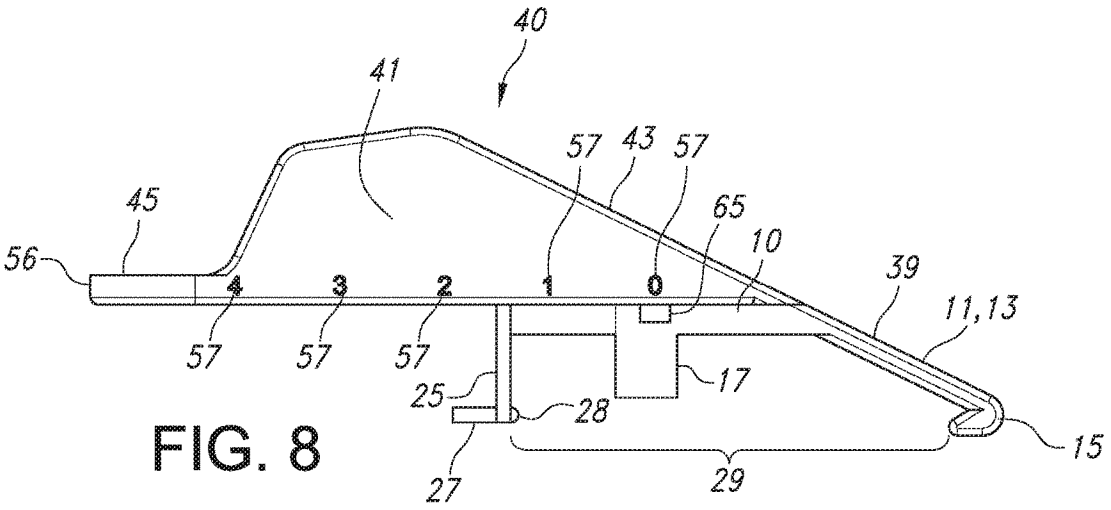

FIG. 8 presents a left-side view of the assembled Clipper Guard 1, primarily showing the left ridge 41 of the Sliding Body 40. Further shown is a left-side view of the Retainer 10 which has been latched onto the Sliding Body 40.

Figure 9:
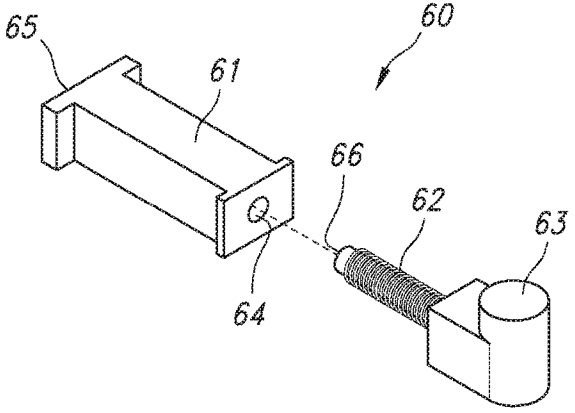

FIG. 9 depicts the pin 60 mechanism, including its housing 61, which retains a spring 62 and rod 66 within a duct 64. Further shown is a cylindrical peg 63 contoured and dimensioned so as to fit snugly into any one of the series of notches 51, 52, 53, 54, 55 within the Sliding Body 40.

Figure 10:
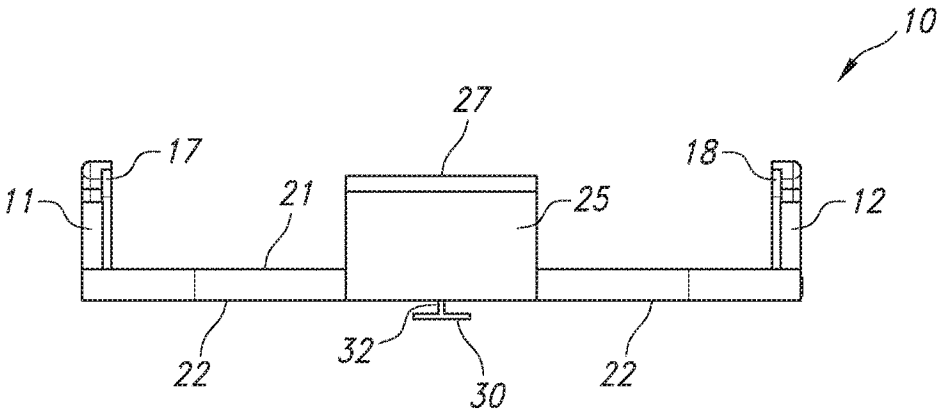

FIG. 10 illustrates a rear view of the Retainer 10, further showing the key 30 and its integral shaft 32, the backside of the bracket 25, the rear edge of the shelf 27, and the left and right posts 17, 18.

Figure 11:
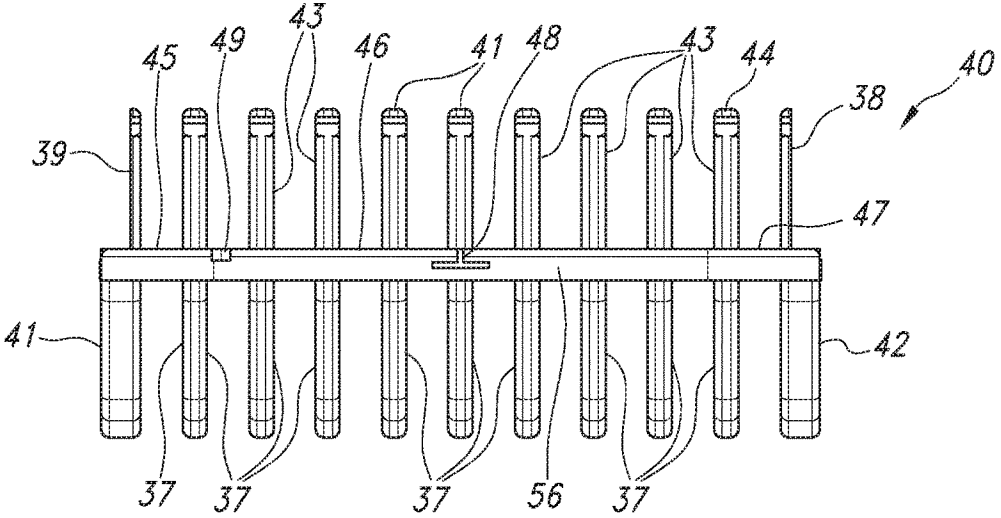

FIG. 11 shows a rear view of the Sliding Body 40. The T-shaped, internal slot 48 is shown machined into the rear of the base flange 56 of the Sliding Body 40. Also shown are partial rear views of the stators 37, prongs 43, and clasps 44.

Figure 12:
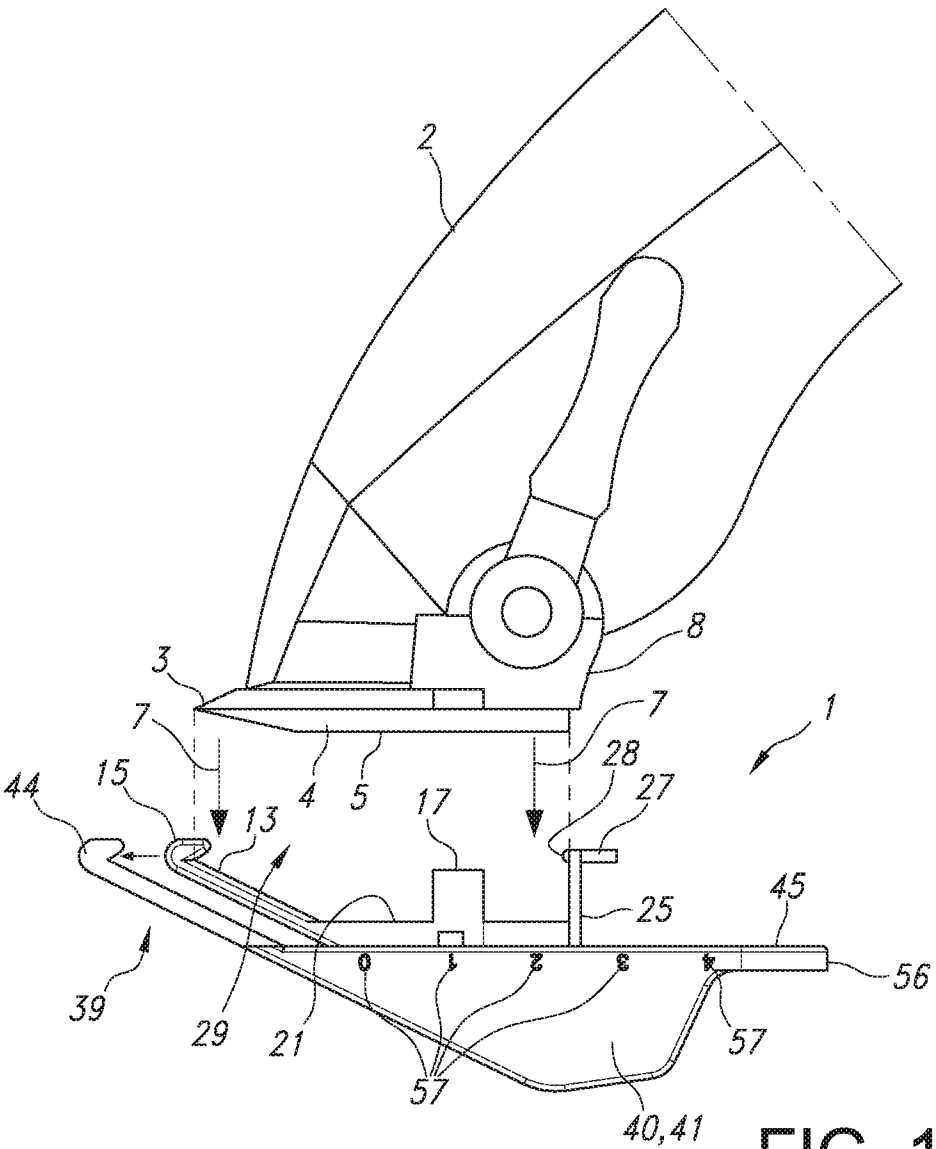

FIG. 12 presents a view of the manner in which a set of hair clippers 2 is accommodated into the Clipper Guard 1, showing the impending placement of the clipper teeth 3 and the teeth holding structure 4 into the confines of the formed chamber 29 of the Retainer 10.

Table of Nomenclature & Part Numbers of Invention

| | |
|---|---|
| 1. | Clipper Guard |
| 2. | Hair clippers |
| 3. | Clipper teeth |
| 4. | Teeth-holding structure |
| 5. | Smooth plane |
| 6. | Direction of joining |
| 7. | Direction of insertion |
| 8. | Rear edge |
| 9. | n/a |
| 10. | Retainer |
| 11. | Left arm |
| 12. | Right arm |
| 13. | Left armrest |
| 14. | Right armrest |

-continued

Table of Nomenclature & Part Numbers of Invention

| | |
|---|---|
| 15. | Left hook |
| 16. | Right hook |
| 17. | Left post |
| 18. | Right post |
| 19. | n/a |
| 20. | n/a |
| 21. | Inner plane |
| 22. | Outer plane |
| 23. | Left ledge |
| 24. | Right ledge |
| 25. | Bracket |
| 26. | n/a |
| 27. | Shelf |
| 28. | Lip |
| 29. | Chamber |
| 30. | Key |
| 31. | n/a |
| 32. | Shaft |
| 33. | Groove |
| 34. | n/a |
| 35. | Bay |
| 36. | Pointer |
| 37. | Stator |
| 38. | Right supporter |
| 39. | Left supporter |
| 40. | Sliding Body |
| 41. | Left ridge |
| 42. | Right ridge |
| 43. | Prong |
| 44. | Clasp |
| 45. | Left plate |
| 46. | Mid-plate |
| 47. | Right plate |
| 48. | Slot |
| 49. | Channel |
| 51. | First notch |
| 52. | Second notch |
| 53. | Third notch |
| 54. | Fourth notch |
| 55. | Fifth notch |
| 56. | Base flange |
| 57. | Indicator |
| 58. | n/a |
| 59. | T/B/D |
| 60. | Pin |
| 61. | Housing |
| 62. | Spring |
| 63. | Peg |
| 64. | Duet |
| 65. | Head |
| 66. | Rod |

DETAILED DESCRIPTION OF THE INVENTION

The objects, features, and advantages of the inventive concept presented in this application are more readily understood when referring to the accompanying drawings. The drawings, totaling twelve figures, show the basic components and functions of embodiments and/or methods of use. In the several figures, like reference numbers are used in each figure to correspond to the same component as may be depicted in other figures.

The discussion of the present inventive concept will be initiated with FIG. 1, where there is illustrated a three-dimensional view of the interior structure of the Clipper Guard 1 mechanism. The Clipper guard 1 comprises the adjoinment of two principal components: a Retainer 10 and a Sliding Body 40. In this view, it is noted that the Sliding Body 40 features three smooth, co-planar surfaces, which are formed by virtue of being divided by an elongated slot 48, and a channel 49. The planar surfaces of the Sliding Body 40 are thereby seen to be three distinguishable surfaces, being a right plate 47, a mid-plate 46 and a left plate 45. The channel 49 opens at symmetrical intervals, into five notches 51, 52, 53, 54, 55, of which the third notch 53, fourth notch 54, and fifth notch 55 are in view in FIG. 1.

The Retainer 10 is shown positioned and secured at a specific location abutting the Sliding Body 40. The Retainer 10 is primarily secured to the Sliding Body 40 by means of a combination key 30 and shaft 32 (not in view in FIG. 1) constructed on the outer plane 22 of the Retainer 10. FIG. 4 and FIG. 10 present clear views of the key 30 and shaft 32. The shaft 32 of the Retainer 10 fits into the slot 48 of the Sliding Body 40 when positioned by a user grasping the integral key 30 and moving the entire Retainer 10 while abutting the Sliding Body 40.

In the preferred embodiment, five different positions of the Retainer 10 may be selected and securely latched onto the Sliding Body 40. This is accomplished by a user pulling outward on the graspable head 65 of a pin 60 mechanism, (more readily shown in FIG. 2) which is connected to a spring-loaded circular peg 63. The user then slidingly moves the Retainer 10 along the interior surfaces of the Sliding Body 40 until reaching the desired relative positions of both components. The pin 60 mechanism is shown in better detail in FIG. 4 and FIG. 9. The peg 63 will mechanically settle into one of the selected notches 51, 52, 53, 54, or 55, when the head 65 of the pin 60 is released by the user.

In the preferred embodiment, the Clipper Guard 1 is appropriately used with common electric hair clippers typically used by barbers and hair stylists. However, other designs or types of clippers, including, but not limited to, those necessary for veterinarian-related uses, horticultural applications, and fabric finishing, may also be operated in conjunction with the disclosed Clipper Guard 1.

As is shown more clearly in FIG. 12, a set of hair clippers 2 may be placed upon the inner plane 21 of the Retainer 10 within the confines of a chamber 29. In this manner, the teeth 3 of the clippers 2 are held in position by (a) a plurality of clasps 44 extending from the prongs 43 of the Sliding Body 40, (b) in the Retainer 10, its left post 17, right post 18, and a bracket 25 having a lip 28. The bracket 25 is a slightly flexible piece that fits snugly against the rear edge 8 of the hair clippers 2 inserted into the chamber 29.

FIG. 2 illustrates a bottom-up view of the Clipper Guard 1 device. Primarily shown are the components of the Sliding Body 40, which consist of, in the preferred embodiment, nine rigid, parallel stators 37, the stators 37 extending lengthwise and transitioning into the same number of tapered, symmetrically-spaced prongs 43. Each of the prongs 43 culminates, at its end, in a rounded clasp 44. The clasps 44 are essential to assisting in the retention of the teeth 3 of a set of hair clippers 2. The base flange 56 of the Sliding Body 40 provides the structural foundation from which each of the stators 37 emanates.

Also shown in FIG. 2, extending from the surface of the base flange 56 is the left ridge 41, which is parallel to, and similar in profile to the nine stators 37. An exact, matching right ridge 42 is formed on the right side of the Sliding Body 40. The left ridge 41 also is the location of five indicators 57, labeled "0, 1, 2, 3, 4," these indicators being located exactly in juxtaposition with the five notches 51, 52, 53, 54, 55 used to set the varying positions of the Retainer 10.

In FIG. 2, there is also shown, being adjoined to the Sliding Body 40, a small segment of the Retainer 10. The left post 17 of the Retainer 10 is visible, along with the graspable head 65 of the pin 60 mechanism. The spring-loaded circular peg 63 is not in view, interiorly to the Retainer 10. Further, a left arm 11, and a right arm 12, both components of the Retainer 10 are visible. The left arm 11 and right arm 12 culminate in a left hook 15 and a right hook 16, respectively. The left and right hooks 15, 16, also are used as an additional means to secure the teeth holding structure 4 of a set of clippers 2.

FIG. 3 and FIG. 4 correspondingly show the undersides of both the Sliding Body 40 and Retainer 10, respectively. Both the Sliding Body 40 and Retainer 10 components are shown having been disconnected and separated one from the other. To complete the preparation of the Clipper Guard 1 for use, the Retainer 10 must be moved in a direction of joining 6. Consequently, the Retainer 10 may be brought in abutment to, and mated with the Sliding Body 40 by means of the key 30 and shaft 32 previously mentioned.

It is to be noted that there is a series of parallel grooves 33 in the outer plane 22 of the Retainer 10 which enable the prongs 43 of the Sliding Body 40 to easily be positioned back and forth within the grooves 33 in the outer plane of the Retainer s a user maneuvers the Sliding Body 40 to lock into any one of the series of notch 51, 52, 53, 54, 55 locations at pre-designed points in the interior of the Sliding Body 40. A primary element which operates in the joining is a combination of a key 30 and shaft 32 shown on the Retainer 10 of FIG. 4. The shaft 32 fits precisely into the slot 48 interiorly to the Sliding Body 40.

FIG. 5 depicts the view of the underside of the Sliding Body 40, further showing its slot 48, the channel 49, a plurality of notches 51, 52, 53, 54, 55, the notches 51, 52, 53, 54, 55 being recessed into an area below the co-planar surfaces of the mid-plate 46 and left plate 45 of the underside of the Sliding Body 40. Each notch, 51, 52, 53, 54, 55 serves, if selected by the user, to retain the peg 63 of the pin 60 mechanism.

Also shown in FIG. 5 are the undersides of nine prongs 43 extending parallel, symmetrically spaced, and outward employed as a guard separating the teeth 3 of a set of clippers 2, from, in the preferred embodiment, the hair of a subject. In this manner also, the Clipper Guard 1 can be engaged in a variety of cutting heights by which hair clippers 2 may function, corresponding to the length and extent of the Retainer 10 movement along the interior surfaces of the Sliding Body 40. The left supporter 39 and right supporter 38 provide a supporting length for the left arm 11 and right arm 12 of the Retainer 10 when the two components are joined.

In all prospective uses of the Clipper Guard 1, the prongs 43 serve as a guard separating the teeth 3 of the clippers 2 from any type of substance or material upon which the Clipper Guard 1 may be applied by a user. Also to be noted are curved clasps 44 at the end of each of the prongs 43 of the Sliding Body 40. These curved clasps 44 functionally serve to retain the cutting edges of the teeth 3 of clippers 2. A left supporter 39 and right supporter 38 provide structural backing enclosing the left arm 11 and right arm 12, respectively, of the Retainer 10 when these two components are connected.

In FIG. 6 there is presented a view of the underside of the Retainer 10, further showing its outer plane 22, the right arm 12, the left arm 11, and the right post 18. The right post 18, along with the left post 17 (not shown), provide lateral retention and stability for the sides of the teeth holding structure 4 (more clearly shown in FIG. 12) of a set of clippers 2. Also shown is the bay 35 which accepts the pin 60 mechanism. Nine grooves 33 are symmetrically spaced to receive small segments of the nine prongs 43 of the Sliding Body 40 when the Sliding Body 40 is attached to the Retainer 10. Further shown in FIG. 6 is a pointer 36 which allows a user to accurately position the pin head 65 at the exact location of the desired notch 51, 52, 53, 54, 55, into which the circular peg 63 will be released.

FIG. 7 displays the interior structure of the Retainer 10, further showing the inner plane 21, left and right posts 17, 18, a bracket 25, a lip 28, grooves 33, the right arm 12, right armrest 14, the left arm 11, and left armrest 13. The right post 18 and left post 17, together, provide lateral retention and stability for the sides of the teeth holding structure 4 of a set of clippers 2. Additionally, the left armrest 13 and right armrest 12 of the Retainer 10 provide support for the teeth holding structure 4 of clippers 2. Further, when the Retainer 10 and Sliding Body 40 are adjoined, the left arm 11 and right arm 12 fit into the inner surface of the left supporter 39 and right supporter 38, respectively, of the Sliding Body 40.

The bracket 25 of the Retainer 10 may be of a semi-rigid material so as to provide retention of the rear edge of the teeth holding structure 4 of clippers 2. A user may firmly place a finger upon the top of the shelf 27 of the bracket 25 as a fulcrum against which the rear edge of the teeth holding structure 4 of a set of clippers 2 may be leveraged. A lip 28 adds additional secure retention of the rear edge of the teeth holding structure 4. Nine grooves 33 are shown symmetrically spaced to receive segments of the nine prongs 43 of the Sliding Body 40.

FIG. 8 presents a left-side view of the assembled Clipper Guard 1, showing the left ridge 41 of the Sliding Body 40, which extends so as to form the left outermost prong 43. Immediately after, and extending further out from the outermost prong 43, there is shown the left arm 11 and left armrest 13 of the Retainer 10 as resting in the left supporter 39. Five indicators 57, used for indicating the placement of varied locations of the pin head 65 and peg 63 (not shown) are shown along the left edge of the Sliding Body 40.

Further shown in FIG. 8 is a left-side view of the Retainer 10, which has been latched onto the Sliding Body 40. The Retainer 10, by virtue of its illustrated components, forms a chamber 29 which chamber 29 is dimensioned to accommodate, in the preferred embodiment, most designs of hair clippers 2. The left post 17, as pointed out earlier, provides lateral retention and stability for the sides of the teeth holding structure 4 of a set of clippers 2. The bracket 25 and lip 28 assist in supplying rearward retention for a set of clippers 2 placed within the chamber 29 of the Retainer 10. Additionally, the left arm 11 (which fits into the left support 39 of the Sliding Body 40) and left armrest 13 provide support for the teeth holding structure 4 of clippers 2. FIG. 8 also displays the head 65 of the pin 60 mechanism, which is essential to adjusting the cutting height or length of the Clipper Guard 40.

FIG. 9 depicts the pin 60 mechanism, its housing 61 which retains a spring 62 mounted upon a cylindrical rod 66, and a circular peg 63 contoured and dimensioned so as to fit snugly into any one of the series of notches 51, 52, 53, 54, 55 within the Sliding Body 40. The rod 66, fitted within the spring 62, is connected at one end to the circular peg 63, and at its other end to the head 65 of the pin 60 mechanism. In this manner a user may grasp the head 65 and pull outwards to withdraw the circular peg 63 from its position within any one of the bays 35 of the notches 51, 52, 53, 54, 55 in the left plate 45 of the Sliding Body 40.

The Retainer 10 is then free to slide along the mid-plate 46 and right plate 47 until the head 65 is positioned at one of the desired indicators 57 displayed on the left ridge 41 (more clearly shown in FIG. 8). At this juncture, the user releases the pin head 65 so that the spring 62 decompresses and allows the peg 63 to drop into the notch 51, 52, 53, 54, or 55 corresponding to the indicator 57 at which the pin head 65 and pointer 63 has arrived. In this manner, a user can position the Retainer 10 along the interior of the Sliding Body 40 at pre-calculated locations. This action thereby adjusts the cutting range and height of the teeth of a set of clippers 2 to effect the cutting and/or trimming of the hair of a customer, or other material that is to be worked on. It is to be noted that the Retainer 10 is constructed with a rectangular, sunken bay 35 (better illustrated in FIG. 4 and FIG. 6) which provides stowage of the pin mechanism 60 at all times.

In FIG. 10 there is illustrated a rear view of the Retainer 10, further showing the key 30 and its integral shaft 32, the backside of the bracket 25, the rear edge of the shelf 27, and rear views of the left and right posts 17, 18. As pointed out previously, the key 30 and shaft 32 form a T-shape, thereby enabling them to fit precisely into the slot 48 (shown in FIG. 11) of the Sliding Body 40.

FIG. 11 presents a rear view of the Sliding Body 40, as it is graphically projected to align with the Retainer 10, shown immediately above in FIG. 10. The T-shaped, internal slot 48 is shown machined into the rear of the base flange 56 of the Sliding Body 40. Also shown are partial rear views of the stators 37, prongs 43, and clasps 44. The interior faces of the prongs 43 and clasps 44 are shown, which prongs 43 and clasps 44 serve to mesh with the teeth 3 of a set of clippers 2 when the clippers 2 are used in conjunction with the Clipper Guard 1.

FIG. 12 illustrates the manner in which a set of hair clippers 2 is accommodated into the Clipper Guard 1, showing the impending placement of the clipper teeth 3 and the teeth holding structure 4 into the confines of the formed chamber 29 of the Retainer 10. The clippers 2 will be moved in a downward direction of insertion 7 such that the smooth plane 5 of the clippers 2 will rest upon the inner plane 21 (out of view) of the Retainer 10. The rear edge 8 of the clippers 2 will be then be engaged and retained by the semi-rigid shelf 27 and lip 28 of the vertical bracket 25 once the clippers 2 are inserted into the formed chamber 29.

While preferred embodiments of the present inventive method have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, as described by the scope of the claims presented herein.

What is claimed is:

1. A two-piece clipper guard device for mechanically adjusting and guiding the cutting and/or trimming height of a set of clippers, the device comprising (a) a planar Retainer having an inner plane, an outer plane, a left arm and left armrest, and a right arm and right armrest extending from the left and right sides of the Retainer, respectively, and a chamber;

(b) a Sliding Body, the Sliding Body further comprising a left supporter, a right supporter, a planar surface having a rearmost base flange with a certain number of parallel stators emanating orthogonally from the base flange, the stators transitioning into a like number of tapered, symmetrically-spaced prongs, with each prong thereby culminating in a fixed, curved clasp, wherein (c) the Retainer comprises a T-shaped key and integral shaft constructed onto its outer plane, and the Sliding Body comprises a correspondingly-dimensioned hollow, lengthwise T-shaped slot, whereby the T-shaped key and shaft of the Retainer fit precisely into the T-shaped slot of the Sliding Body, thereby enabling the joining together of the Retainer and Sliding Body.

2. A clipper guard device as in claim 1, wherein (a) the Retainer comprises a stowage hay for retention of a pin mechanism, the pin mechanism further comprising a housing, a spring-loaded rod and a cylindrical peg attached to the rod; and (b) the Sliding Body further comprising a linear channel, which linear channel branches into a series of circular notches, each notch having dimensions specifically to accommodate a circular diameter of the cylindrical peg of the retainer.

3. An attachment clipper guard for use with hair clippers, comprising:

(a) a Sliding Body having an upper structure comprising three co-planar surfaces separated by a T-shaped slot and a linear channel, the linear channel having a plurality of symmetrically-spaced, circular notches; a left supporter integrally extending from the left edge of the Sliding Body, and a right supporter integrally extending from the right edge of the Sliding Body; and an understructure comprising a plurality of parallel stators transitioning into an equal number of parallel prongs, the end of each prong culminating in a clasp;

(b) a Retainer having an outer plane comprising a T-shaped key and integral shaft, a pin mechanism further comprising a housing, a spring-loaded rod with A circular peg attached to the rod, a rectangular-shaped sunken bay having dimensions corresponding to dimensions of the pin mechanism, a plurality of grooves, an inner plane comprising a bracket having an orthogonal ledge and lip, left and right posts, left and right arms, left and right armrests, with each armrest terminating in a hook; wherein (c) the outer plane of the Retainer is positioned and secured at specific locations abutting the Sliding Body by means of the T-shaped key and shaft inserted into the slot of the Sliding Body, thereby causing the parallel prongs of the Sliding Body to slide back and forth within the grooves in the outer plane of the retainer, and further, enabling stowage of the circular peg of the pin mechanism within the recessed bay of the outer plane of the Retainer.

4. A clipper guard as in claim 3 wherein the pin mechanism of the Retainer comprises a mechanically positionable, spring-loaded pin and circular peg combination, such that, as the Retainer is moved along the slot of the Sliding Body, placement of the circular peg into one of the notches of the Sliding Body is enabled, serving to control the exposed edges of the teeth of a hair clipper, in accordance with the desired length to which a subject's hair may be cut or trimmed.

5. A two-piece clipper guard device for mechanically adjusting, positioning, and guiding the height and exposed cutting teeth of a set of clippers, the device comprising (a) a planar Retainer having a left support arm and right support arm extending, in a parallel manner, from the left and right sides of the Retainer, respectively; an outer plane having a T-shaped key and shaft protruding orthogonally therefrom, an internally-stowed pin mechanism terminating an internal, spring-loaded circular peg, a plurality of grooves, an inner plane comprising a bracket having an orthogonal ledge and lip, left and right posts, left and right arms, each arm terminating in a hook; and (b) a Sliding Body, the Sliding Body comprising a left support, a right support, a planar surface having a rearmost base flange, the base flange having a lengthwise T-shaped slot running therethrough, a linear channel branching into a plurality of symmetrically-spaced, circular notches and further, a number of parallel stators emanating orthogonally from the base flange, the stators transitioning into an equal number of tapered, parallel, symmetrically-spaced prongs, each prong culminating in a fixed, curved clasp; wherein the Sliding Body accepts adjoinment of the Retainer by means of insertion and fit of the T-shaped key of the Retainer internally into the T-shaped slot of the Sliding body; and the adjoinment of the Sliding Body and Retainer enable the resulting clipper guard device to adjustably grasp a set of clippers within the left and right posts, bracket, orthogonal ledge, lip, left and right arms, and armrests of the Retainer; wherein as the Retainer is moved along the slot of the Sliding Body, placement of the circular peg of the Retainer into one of the notches of the Sliding Body is enabled, serving to control the length of the exposed edges of the teeth of a hair clipper, in accordance with the desired length or height to which a substance may be cut or trimmed.

* * * * *